US007971934B2

(12) United States Patent
LaPointe et al.

(10) Patent No.: US 7,971,934 B2
(45) Date of Patent: Jul. 5, 2011

(54) LUMBAR SUPPORT SYSTEM FOR FURNITURE MEMBER

(75) Inventors: Larry P. LaPointe, Temperance, MI (US); Chad Edward Adams, Perrysburg, OH (US); Mark D. McClung, Grandview, TN (US)

(73) Assignee: La-Z-Boy Incorporated, Monroe, MI (US)

( * ) Notice: Subject to any disclaimer, the term of this patent is extended or adjusted under 35 U.S.C. 154(b) by 304 days.

(21) Appl. No.: 12/338,321

(22) Filed: Dec. 18, 2008

(65) Prior Publication Data

US 2010/0156158 A1 Jun. 24, 2010

(51) Int. Cl.
*A47C 3/00* (2006.01)
*A47C 7/46* (2006.01)

(52) U.S. Cl. ..... 297/284.4; 297/284.1; 297/284.7

(58) Field of Classification Search ..... 297/284.1, 297/284.4, 284.7
See application file for complete search history.

(56) References Cited

U.S. PATENT DOCUMENTS 4,159,847 A * 7/1979 Arai ..... 297/284.4
5,217,278 A 6/1993 Harrison et al.
5,385,388 A * 1/1995 Faiks et al. ..... 297/301.3
5,984,407 A 11/1999 Ligon, Sr.
6,145,924 A * 11/2000 Mero et al. ..... 297/68
6,666,511 B2 * 12/2003 Schuster et al. ..... 297/284.1
7,131,694 B1 * 11/2006 Buffa ..... 297/284.4
7,137,664 B2 11/2006 MacMillen et al.
2002/0113472 A1 8/2002 Blendea et al.
2004/0104609 A1 6/2004 Blendea
2006/0103204 A1 5/2006 Walker et al.

OTHER PUBLICATIONS

International Search Report for International Application No. PCT/US2009/065230 mailed Jul. 5, 2010.
Written Opinion of the International Searching Authority for International Application No. PCT/US2009/065230 mailed Jul. 5, 2010.

* cited by examiner

*Primary Examiner* — David Dunn
*Assistant Examiner* — Philip Gabler
(74) *Attorney, Agent, or Firm* — Harness, Dickey & Pierce, P.L.C.

(57) ABSTRACT

An occupant lumbar support system includes a flexible lumbar support member having homogenously connected first and second connection braces. The lumbar support member is deflectable to a plurality of lumbar support positions. A rigid displacement rod is connected at a first rod end to one of the connection braces. A lumbar member actuation mechanism has a rotatable first actuation arm receiving a second displacement rod end. The actuation member translates the displacement rod causing the first and second connection braces to move toward each other, deflecting the lumbar support member to any of the lumbar support positions. A cable is connected at a first end to an actuation mechanism second actuation arm and at a second end to a displaceable lever manually movable to co-rotate the first and second actuation arms and translate the displacement rod.

27 Claims, 13 Drawing Sheets

LUMBAR SUPPORT SYSTEM FOR FURNITURE MEMBER

FIELD

The present disclosure relates to lumbar support systems for furniture including occupant support members.

BACKGROUND

This section provides background information related to the present disclosure which is not necessarily prior art.

Conventionally, reclining articles of furniture (i.e., chairs, sofas, loveseats, and the like), referred to hereinafter generally as reclining chairs, utilize a mechanism to bias a leg rest assembly in extended and stowed positions and separate components to allow a back seat member to recline with respect to a seat base. Known furniture members can also include mechanism designs that also permit the reclining chair to rock in a front-to-back motion with respect to an occupant. Occupant lumbar support is commonly provided by one or more cushion members which abut with or are connected to a horizontally configured member such as a strap or similar flexible member. This member is commonly joined at its ends to vertically oriented backrest side support arms which are in turn rotatably connected to a furniture member chair frame.

Most reclining chairs upholster the chair frame and support the chair frame from a stationary base assembly in a manner permitting the chair frame to "rock" freely with respect to the base assembly. In order to provide enhanced comfort and convenience, many rocking chairs also include a "reclinable" seat assembly and/or an "extensible" leg rest assembly. For example, combination platform rocking/reclining chairs, as disclosed in Applicant's U.S. Pat. Nos. 3,096,121 and 4,179,157, permit reclining movement of the seat assembly and actuation of the leg rest assembly independently of the conventional "rocking" action. The leg rest assembly is operably coupled to a drive mechanism to permit the seat occupant to selectively move the leg rest assembly between its normally retracted (i.e., stowed) and elevated (i.e., extended or protracted) positions.

Because lumbar support is substantially fixed to the back seat member, as the back seat member rotates the lumbar cushion(s) will commonly extend forwardly and upwardly. This creates a different lumbar support "feeling" for the different rotated positions of the seat back. The above lumbar support systems are not adjustable by the occupant, and therefore can result in discomfort in either the fully reclined or upright positions, or in the leg rest extended position for different occupants.

SUMMARY

This section provides a general summary of the disclosure, and is not a comprehensive disclosure of its full scope or all of its features. Co-pending disclosures having Ser. Nos. 12/338,392 and 12/338,545 each filed on the same date as the present disclosure are commonly assigned to the assignee of the present disclosure. The entire disclosures of each of the above applications identified by Ser. Nos. 12/338,392 and 12/338,545 are incorporated herein by reference.

According to several embodiments of the present disclosure, an occupant lumbar support system for a furniture member includes a flexible occupant lumbar support member having first and second connection braces. The lumbar support member is deflectable to any one of a plurality of occupant lumbar support positions. At least one guide rod is slidably disposed through both the first and second connection braces operating to slidingly guide one of the first and second connection braces during movement toward and away from the other of the first and second connection braces. A support tube oriented transverse to the guide rod is rotatable to maintain continuous contact of the support tube and the guide rod such that the support tube provides continuous contact support for a first end of the lumbar support member.

According to other embodiments, an occupant lumbar support system for a furniture member includes a flexible occupant lumbar support member having first and second connection braces. The lumbar support member is deflectable to any one of a plurality of occupant lumbar support positions. A rigid displacement rod is connected at a first rod end to one of the first and second connection braces. A lumbar member actuation mechanism positioned rearward of the lumbar support member has a rotatable first actuation arm engageably receiving a second rod end of the displacement rod. The lumbar member actuation member operates to translate the displacement rod causing one the first and second connection braces to move toward the other of the first and second connection braces, deflecting the flexible occupant lumbar support member to any one of a plurality of lumbar support positions. A cable is connected at a first end to a second actuation arm of the lumbar member actuation mechanism and at a second end to a displaceable lever manually movable to co-rotate both the first and second actuation arms and to translate the displacement rod.

According to still other embodiments, a furniture member lumbar support system includes a back support portion connected to a base portion, the back support portion including opposed first and second wings. A lumbar support system is connected to the back support portion. The lumbar support system includes a support tube rotatably connected to the first and second opposed wings. A flexible occupant lumbar support member is in continuous contact with but is not connected to the support tube. A lumbar adjustment mechanism is supported by the base portion and operates to deflect the lumbar support member to a plurality of lumbar support positions.

According to further embodiments, a furniture member lumbar support system includes a back support portion connected to a base portion. The back support portion includes opposed substantially vertically oriented first and second wings. A lumbar support system connected to the back support portion includes a support tube having a tube body with opposed first and second tube ends oriented transverse to the tube body. The first and second tube ends are individually rotatably connected to one of the first and second opposed wings. A flexible occupant lumbar support member is in continuous contact with but is not connected to the support tube at a first end of the lumbar support member. A biasing member connected to the first and second wings and to a second end of the lumbar support member allows forward and rearward movement of the second end.

According to further embodiments, a method for controlling an occupant lumbar support system of a furniture member, including a flexible occupant lumbar support member having homogenously connected first and second connection braces, first and second guide rods, and a support tube comprises: slidably disposing both the first and second guide rods through both the first and second connection braces to guide the first and second connection braces for movement toward and away from each other; biasing a rotatable support tube transversely oriented to the first and second guide rods to maintain continuous contact of a body of the support tube with the first and second guide rods such that the support tube provides continuous contact support for a first end of the lumbar support member; and deflecting the lumbar support member to any one of a plurality of occupant lumbar support positions.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
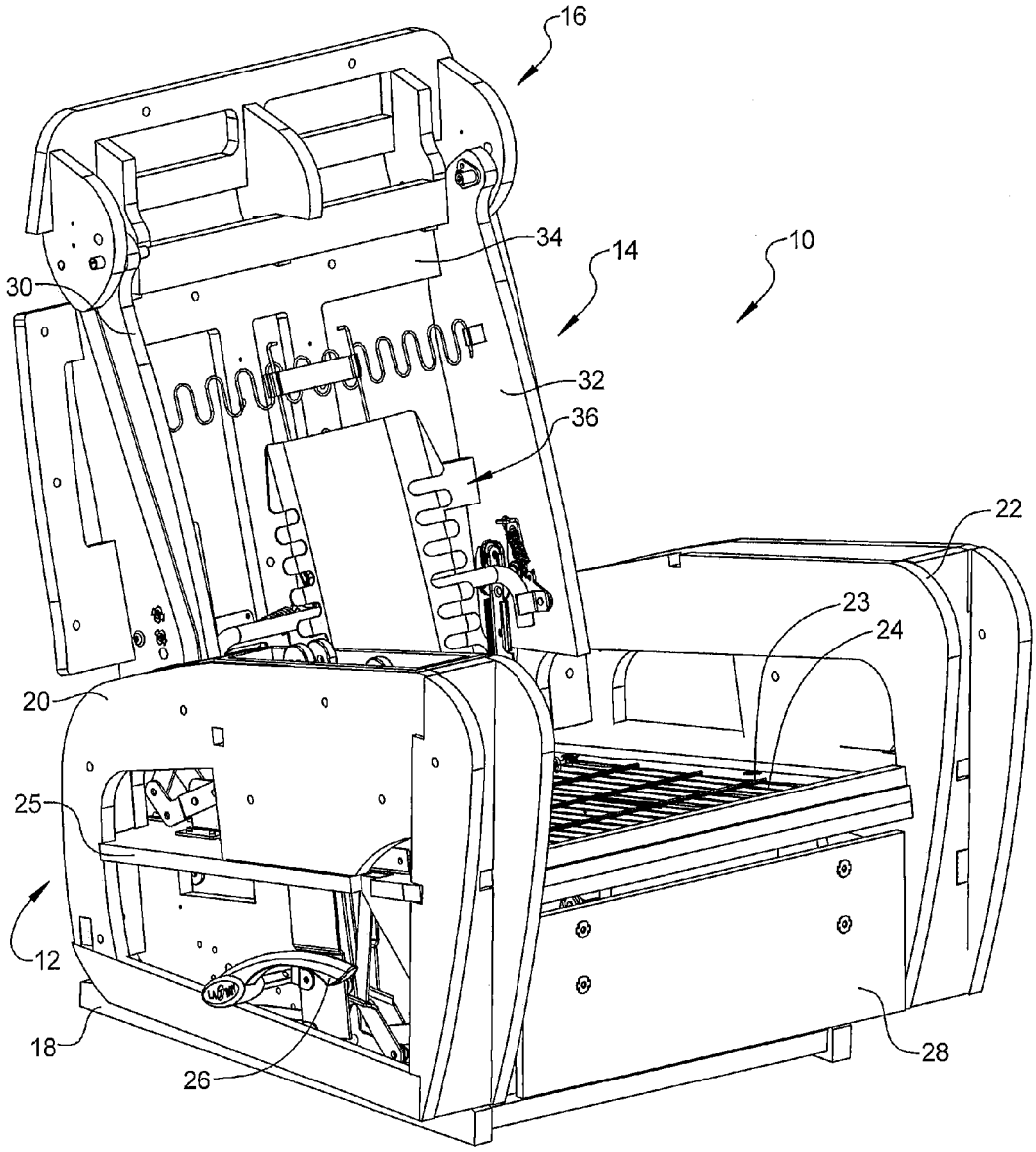
FIG. 1 is a front right perspective view of a furniture member having a lumbar support system of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, a furniture member 10 of the present disclosure is presented generally in the form of a rocking, reclining chair, however furniture member 10 can be any type of seating or occupant support member including a sofa, love-seat, sectional member, non-rocking reclining chair or the like. Furniture member 10 includes a base portion 12 which can fixedly or rotatably support a back support portion 14. According to several embodiments, a head rest portion 16 can be connected to back support portion 14. A base support section 18 which is connected to base portion 12 can be positioned on a planar surface such as a floor. First and second armrest members 20, 22 are fixedly connected to base portion 12 and provide occupant arm support and additional features that will be further described herein.

A plurality of sinuous wire members 23 can be suspended over a cavity 24 created within a frame pan 25 of base portion 12. Sinuous wire members 23 provide vertical support for the weight of an occupant of furniture member 10, with the sinuous wire members being allowed to downwardly deflect into the cavity 24. According to several embodiments, sinuous wire members 23 are made of a spring steel material. When the weight of the occupant is supported by sinuous wire members 23, back support portion 14 provides a back or back rest support for the occupant of furniture member 10. A leg rest extension device 26 such as a hand lever or switch can be used to extend and/or retract an occupant leg rest 28 (shown in a fully retracted position).

Back support portion 14 can be formed from wood members such as first and second side frame members 30, 32 which are connected to a rear frame member 34. A lumbar support system 36 can be movably connected to rear frame member 34. A support position of lumbar support system 36 can be varied from the fully retracted position shown in FIG. 1 forward toward the lumbar region of an occupant of furniture member 10 at the discretion of the occupant.

Figure 2:
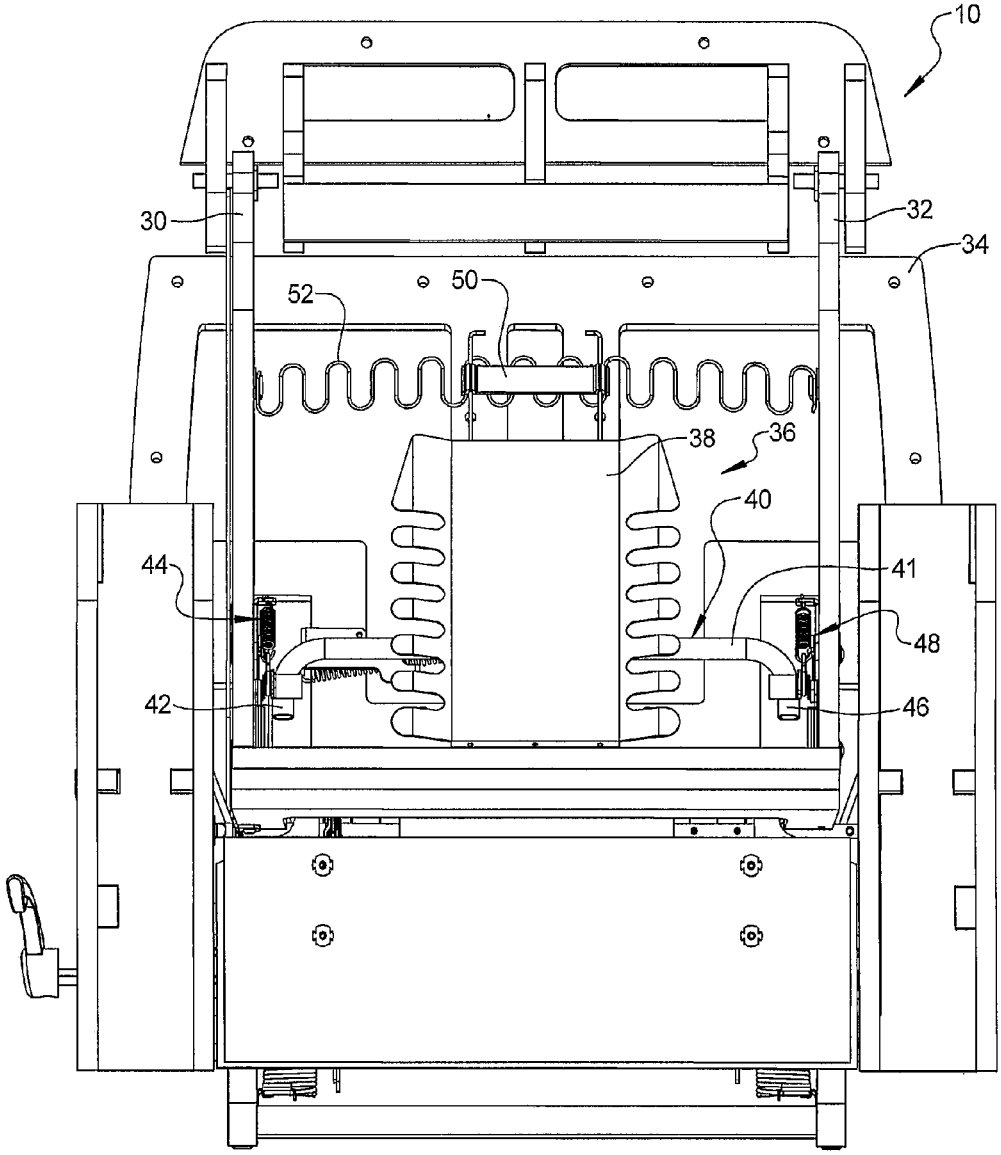
FIG. 2 is a front elevational view of the furniture member of FIG. 1.

Referring to FIG. 2, lumbar support system 36 provides a flexible body 38 which is movably supported at a lower end by a support tube 40. Support tube 40 includes a central tube body 41 having a first tube end 42 connected to first side frame member 30 by a first support tube biasing mechanism 44. Similarly, a second tube end 46 of body 41 is connected to second side frame member 32 using a second support tube biasing mechanism 48. First and second tube ends 42 and 46 are each configured substantially transverse to the generally horizontal orientation of central tube body 41. The rearward deflection of an upper end of flexible body 38 can be restrained by contact with rear frame member 34 at a connecting element 50. Connecting element 50 is attached to a flexible member 52 which is connected at opposite ends to each of first and second side frame members 30, 32. According to several embodiments flexible member 52 is a sinuous wire spring which is supported at opposite ends and therefore allows for movement in either a forward or rearward direction with respect to connecting element 50.

Figure 3:
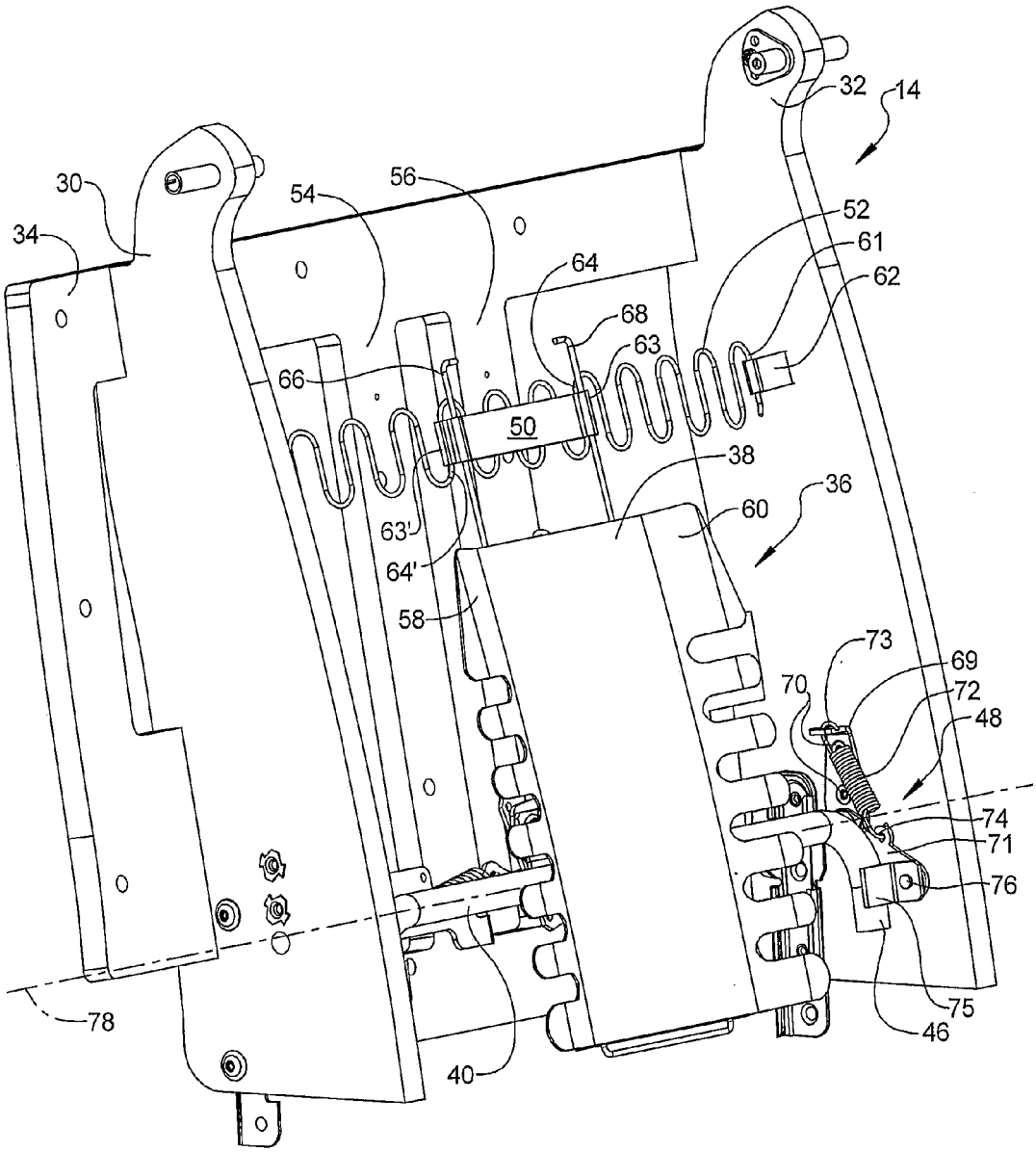
FIG. 3 is a front right perspective view of the lumbar support system of FIG. 1 connected to a back support portion.

Referring to FIG. 3, rear frame member 34 can include first and second frame elements 54, 56 which provide a positive stop for displacement of flexible body 38 and connecting element 50, as well as flexible member 52. Flexible body 38 can also include first and second body wings 58, 60. First and second body wings 58, 60 provide lateral support for the occupant with respect to back support portion 14. Flexible member 52 includes opposed connection ends 61, 61' (only connection end 61 is visible in FIG. 3). A clip 62 is used to connect each of the connection ends 61, 61' of flexible member 52 to individual ones of the first and second side frame members 30, 32. Connecting element 50 is fixed to flexible member 52 by a first and a second coupling portion 63, 63' which are snap-engaged to first and second legs 64, 64' of flexible member 52. Connecting element 50 is also connected to each of a first and a second guide rod 66, 68 which are arranged substantially parallel to each of first and second side frame members 30, 32. The connection of connecting element 50 to each of the first and second guide rods 66, 68 is a sliding connection which allows limited vertical displacement of connecting element 50 with respect to first and second guide rods 66, 68 as the weight of the occupant on back support portion 14 flexes flexible member 52 either forwardly or rearwardly from the position shown in FIG. 3.

Components of second support tube biasing mechanism 48 are similar to the components of first support tube biasing mechanism 44 (not shown in FIG. 3), therefore the following discussion of the components of second support tube biasing mechanism 48 is also applicable to first support tube biasing mechanism 44. Second support tube biasing mechanism 48 includes a biasing mechanism bracket 69 which is connected to second side frame member 32 using a plurality of bracket pins 70. Biasing mechanism bracket 69 is rotatably connected to a biasing mechanism bracket arm 71, and both biasing mechanism bracket 69 and biasing mechanism bracket arm 71 are biased with respect to each other using a first support tube biasing element 72 such as a tension spring. First support tube biasing element 72 includes a first connecting leg 73 which is connected to biasing mechanism bracket 69, and a second connecting leg 74 which is connected to biasing mechanism bracket arm 71. A biasing mechanism connection bracket 75 is fixed to second tube end 46 and is rotatably connected to biasing mechanism bracket arm 71 using a connection bracket pin 76. A support tube longitudinal axis 78 defines a null or initial position for support tube 40 when flexible body 38 of lumbar support system 36 is in the fully retracted position shown in FIG. 3.

Figure 4:
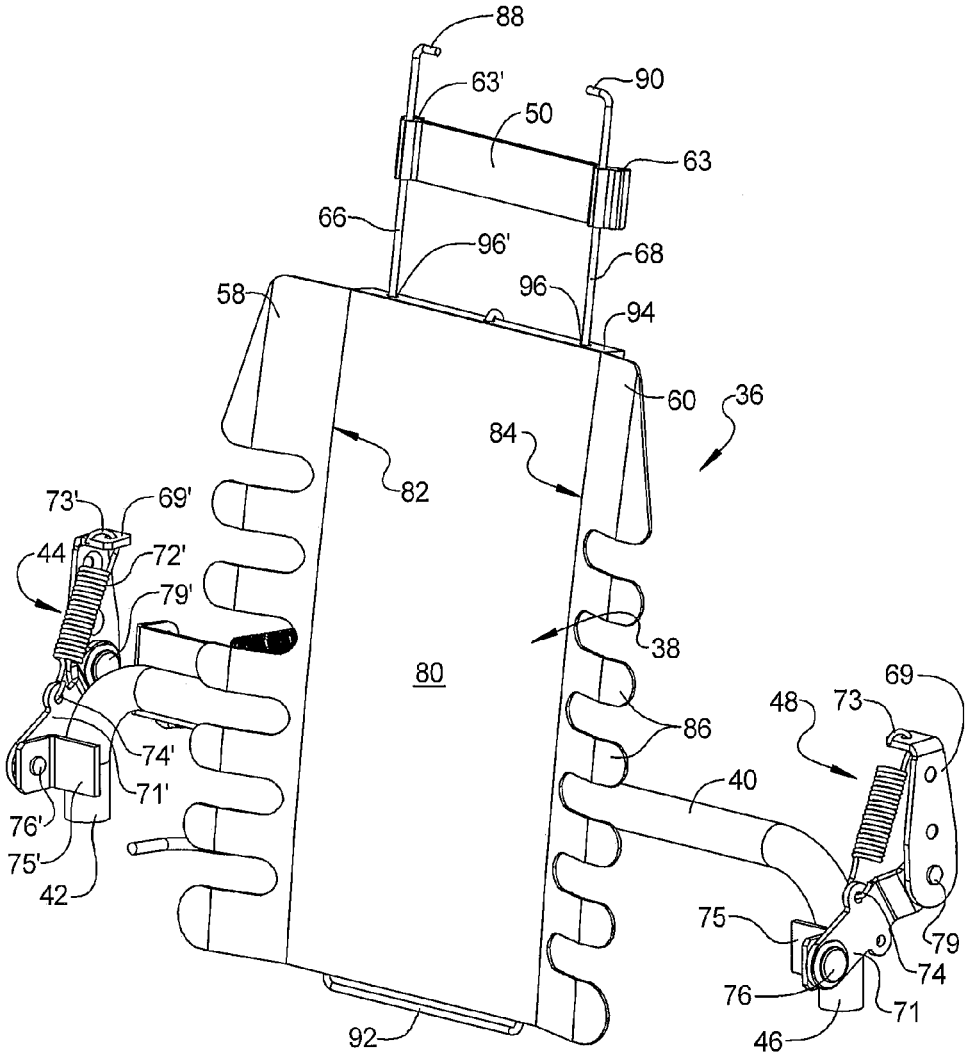
FIG. 4 is a front left perspective view of the lumbar support system of FIG. 3.

Referring to FIG. 4, a sub-assembly of lumbar support system 36 prior to installation in furniture member 10 is shown. The component parts of first and second support tube biasing mechanisms, 44, 48 are generally arranged as mirror image configurations of each other. The biasing mechanism brackets 69, 69' are rotatably connected to the biasing mechanism bracket arms 71, 71' using a rotational fastener 79, 79' such as a rivet. Flexible body 38 further includes a body panel 80 which is delineated from the first and second body wings 58, 60 by first and second bends 82, 84. First and second bends 82, 84 allow first and second body wings 58, 60 to extend forwardly with respect to body panel 80 and therefore provide lateral support for the occupant of the furniture member. A plurality of support fingers 86 are created in each of the first and second body wings 58, 60. The support fingers 86 provide additional flexibility of the first and second body wings 58, 60 along the back area of the occupant of the furniture member.

First and second rod ends 88, 90 are created for example by bending first and second guide rods 66, 68 at an angle, for example, substantially transverse to a longitudinal axis of the first and second guide rods 66, 68. First and second rod ends 88, 90 provide positive stops for displacement of connecting element 50 with respect to the first and second guide rods 66, 68. A rod joining end 92 defines a substantially U-shape for the combination of the first and second guide rods 66, 68 and rod joining end 92. Rod joining end 92 also provides a positive stop for downward displacement of flexible body 38. A sliding motion of flexible body 38 on each of the first and second guide rods 66, 68 is permitting by sliding engagement between the first and second guide rods 66, 68 with respect to a first connection brace 94 which is fixedly or homogonously connected to body panel 80. The sliding motion of first and second guide rods 66, 68 with respect to first connection brace 94 is allowed by a sliding fit with first and second rod apertures 96, 96' created in first connection brace 94.

Figure 5:
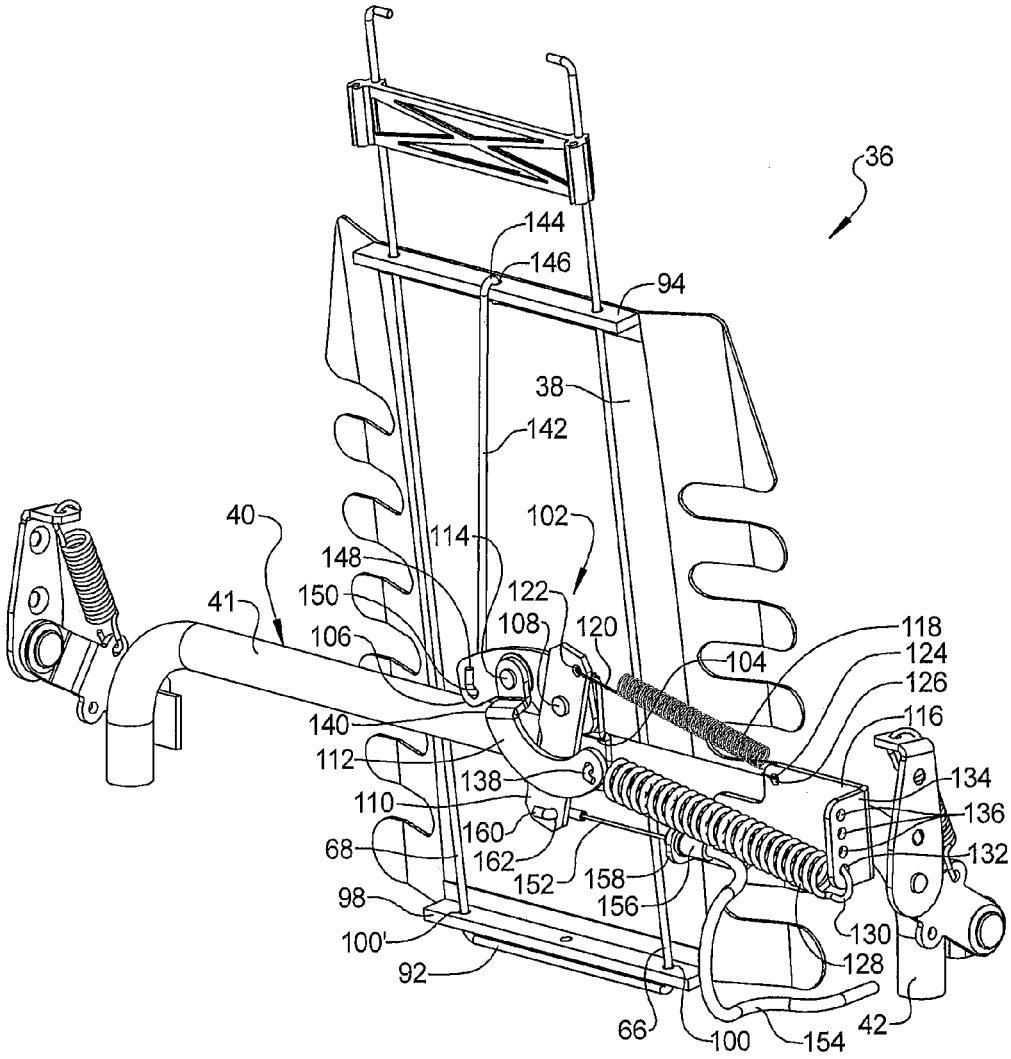
FIG. 5 is a rear right perspective view of the lumbar support system of FIG. 4.

Referring to FIG. 5, a second connection brace 98 which is similar to first connection brace 94 is fixedly connected to or homogonously extends from flexible body 38 at an opposite end of flexible body 38 with respect to first connection brace 94. Rod joining end 92 provides a positive stop during downward displacement of second connection brace 98. First and second rod apertures 100, 100' created in second connection brace 98 allow for sliding motion of second connection brace 98 with respect to first and second guide rods 66, 68.

A lumbar member actuation mechanism 102 is connected to a rear facing surface of central tube body 41. Lumbar member actuation mechanism 102 includes a mounting plate 104 fixedly connected to support tube 40 for example by fastening or welding. A first actuation arm 106 is rotatably connected to mounting plate 104 using a first actuation arm pin 108. A second actuation arm 110 is rotatably connected to first actuation arm 106 also using first actuation arm pin 108. A third actuation arm 112 is rotatably connected to first actuation arm 106 using a second actuation arm pin 114.

A biasing element connection bracket 116 is also fixedly connected to support tube 40 proximate to first tube end 42, for example by fastening or welding. A first tension spring 118 is connected between an upper end of second actuation arm 110 and biasing element connection bracket 116 to bias second actuation arm 110 in a generally clockwise direction of rotation about first actuation arm pin 108 as viewed in FIG. 5. A first spring leg 120 of first tension spring 118 is connected through an aperture 122 of second actuation arm 110. A second spring leg 124 is connected through an aperture 126 of biasing element connection bracket 116. A second tension spring 128 is connected between third actuation arm 112 and biasing element connection bracket 116 by a first spring leg 130 received in an aperture 132 of a bracket leg 134 of biasing element connection bracket 116. A second spring leg 138 is connected through an aperture in third actuation arm 112 at an opposite end of third actuation arm 112 from the position of second actuation arm pin 114. According to several embodiments a spring constant $K_2$ of second tension spring 128 is larger than a spring constant $K_1$ of first tension spring 118 and therefore provides a larger spring bias force than first tension spring 118. Second tension spring 128 in the fully retracted position of flexible body 38 shown in FIG. 5 is flexibly extended, however its biasing force acts through second actuation arm pin 114 which is positioned above first actuation arm pin 108, creating an over-center force path which allows the smaller biasing force created by first tension spring 118 to retain the fully retracted position of flexible body 38. Bracket leg 134 also provides a plurality of spring tension adjustment apertures 136 which can be used as substitutes for receiving first spring leg 130 to adjust the spring force applied by second tension spring 128 at the discretion of the manufacturer. An offset portion 140 of third actuation arm 112 provides motion clearance between third actuation arm 112 and second actuation arm 110.

A rigid displacement rod 142 includes a first rod hook end 144 disposed through a hook receiving aperture 146 of first connection brace 94. A second rod hook end 148 is engaged through a hook receiving aperture 150 created in first actuation arm 106. A flexible cable 152 which is slidably received in a cable sheath 154 provides the motive force for the occupant of the furniture member to adjust a flex position of the flexible body 38 of lumbar support system 36. A cable sheath stop 156 is connected to a sheath retention bracket 158 of biasing element connection bracket 116. A cable connection leg 160 which is formed on a free end of cable 152 is received in a cable receiving aperture 162 created at a lower end of second actuation arm 110. An opposite end of cable 152 (not shown in this view) is connected to a mechanism which will be discussed in further detail in reference to FIG. 13. According to additional embodiments, displacement rod 142 can be similarly connected to second connection brace 98 instead of first connection brace 94, and the orientation of lumbar member actuation mechanism 102 reversed to cause an upward motion of the reverse oriented displacement rod 142. Displacement rod 142 can therefore be connected at a first end to either one of the first and second connection braces 94 or 98.

Figure 6:
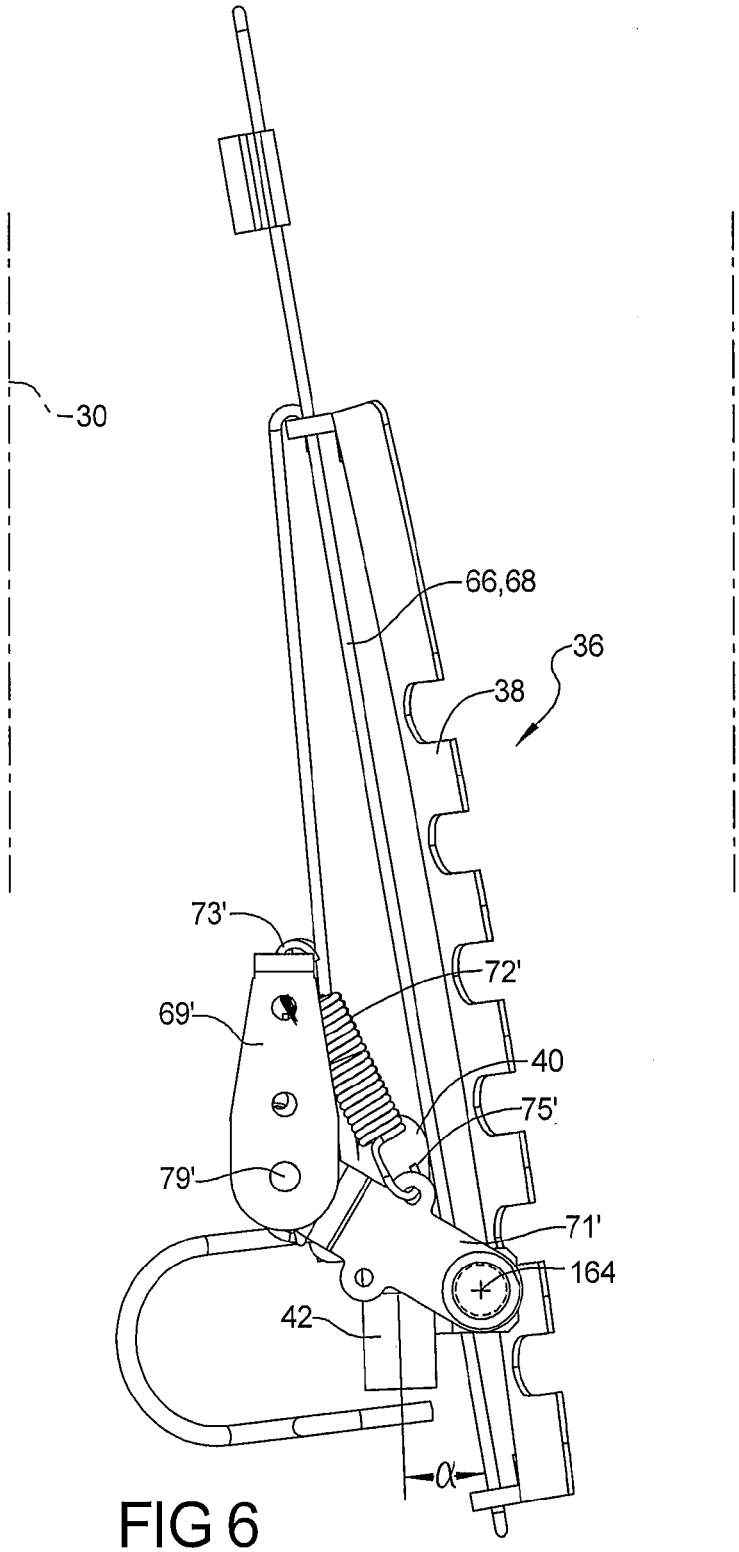
FIG. 6 is a right side elevational view of the lumbar support system of FIG. 4 in a fully retracted position.

Referring to FIG. 6, when the lumbar support system 36 is positioned in the retracted position and the first side frame member 30 is in the upright position (shown in phantom) support tube 40 is in contact with the first and second guide rods 66, 68 to retain the general configuration shown for flexible body 38. In the upright position, first tube end 42 defines an angle $\alpha$ with respect to first and second guide rods 66, 68. First support tube biasing element 72' is substantially contracted and provides little or no biasing force between biasing mechanism bracket 69' and biasing mechanism bracket arm 71'.

Referring to FIG. 7 and again to FIG. 6, as first side frame member 30 is rotated rearwardly to a reclined position (shown in greater detail in reference to FIG. 13), biasing mechanism bracket 69 rotates in a general rearward direction "A" about rotational fastener 79' and biasing mechanism bracket arm 71' rotates about an arc "B" with respect to a pin rotation axis 164 defined by connection bracket pin 76'. First tube end 42 rotates in a clockwise direction until first tube end 42 defines an angle $\beta$ with respect to first and second guide rods 66, 68. This clockwise rotation of first tube end 42 maintains contact between support tube 40 and first and second guide rods 66, 68 such that flexible body 38 continues to provide lumbar support throughout the rotation of the first and second side frame members 30, 32 to the reclined position. The combined rotation of biasing mechanism bracket 69 in the direction "A" about an axis of rotational fastener 79' and the clockwise rotation of biasing mechanism bracket arm 71' in the rotational direction "B" extends support tube biasing element 72' which therefore creates a biasing force in first support tube biasing element 72'. This biasing force assists in returning the configuration of first support tube biasing mechanism 44 to the arrangement shown in FIG. 6 when the first and second side frame members 30, 32 are returned to the upright position. Support tube 40 therefore continuously contacts first and second guide rods 66, 68 to maintain continuous lower lumbar support to the occupant of the furniture member throughout the entire rotation of back support portion 14 between the upright and the fully reclined positions.

Figure 8:
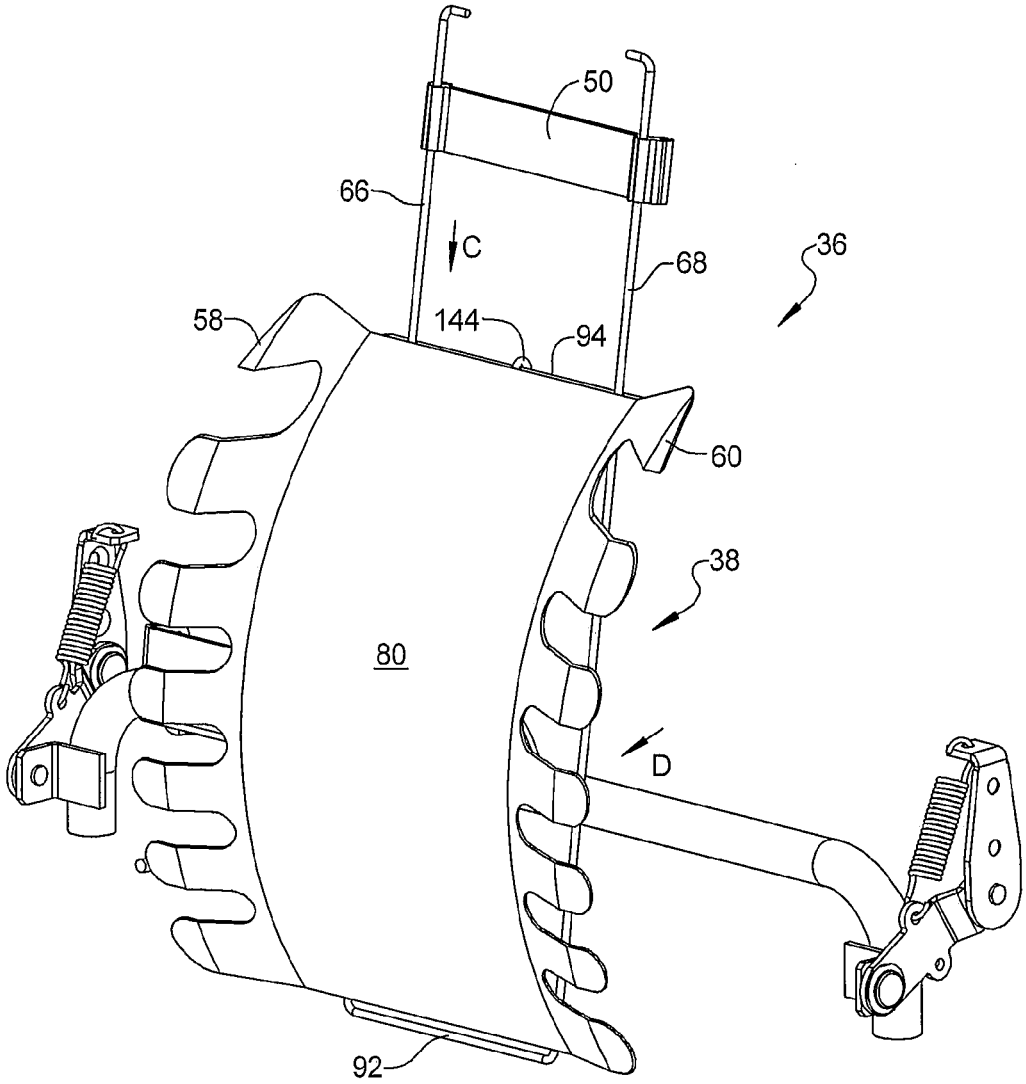
FIG. 8 is a front left perspective view of the lumbar support system in an extended position.

Referring to FIG. 8 and again to FIG. 5, a fully extended or fully arched position of body panel 80 of flexible body 38 can be provided at the discretion of the occupant by repositioning the cable 152 shown in FIG. 5. Retracting cable 152 into cable sheath 154 reconfigures lumbar member actuation mechanism 102 to provide a downward displacement of first connection brace 94 with respect to rod joining end 92. First rod hook end 144 in contact with first connection brace 94 pulls first connection brace 94 in a downward direction "C" which creates a forward bending or bowing of body panel 80 in a forward direction "D" thus increasing lumbar support for the occupant. The maximum forward bowed point of body panel 80 occurs substantially midway between first connection brace 94 and rod joining end 92.

Figure 9:
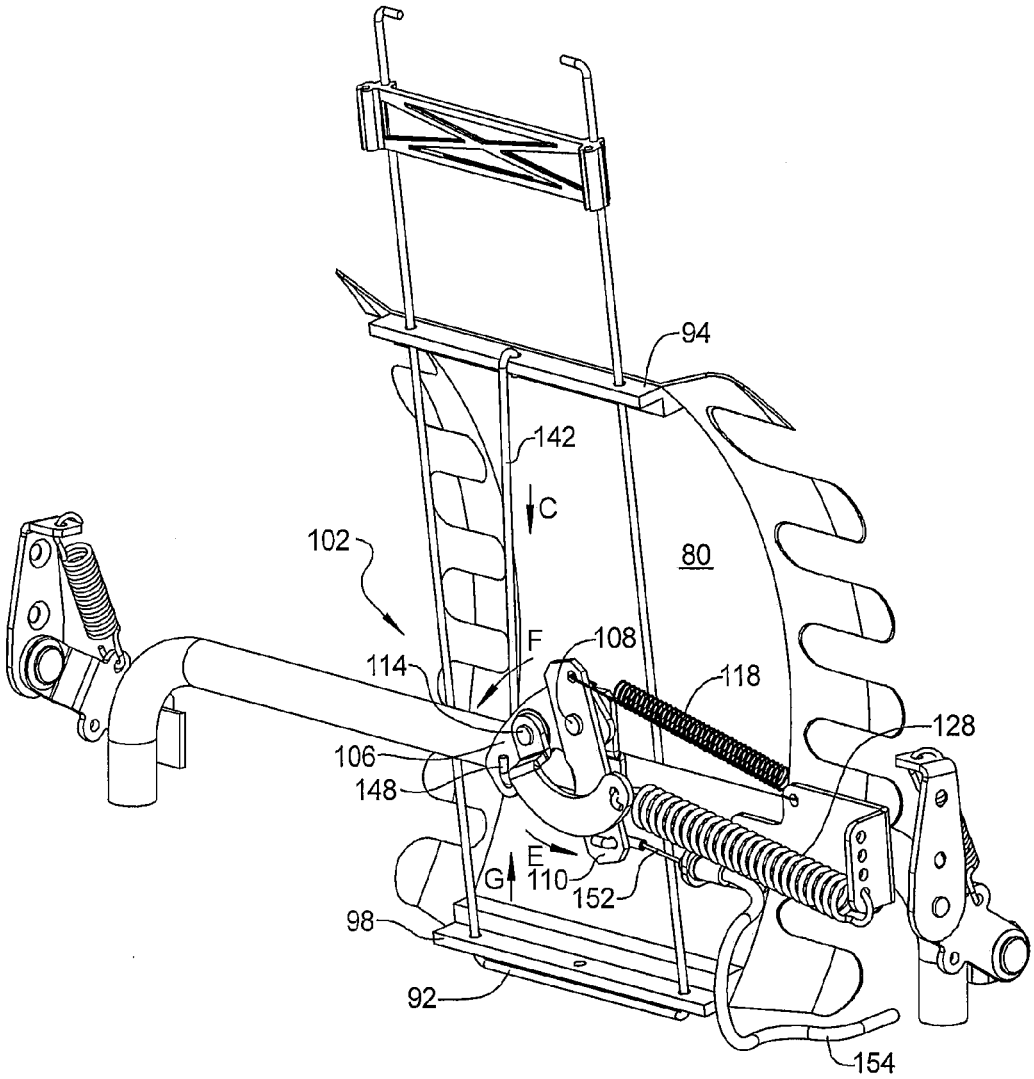
FIG. 9 is a rear right perspective view of the lumbar support system in the extended position.

Referring to FIG. 9, as cable 152 retracts into cable sheath 154 second actuation arm 110 is rotated about first actuation arm pin 108 in a counterclockwise direction of rotation "E". Because first actuation arm 106 is frictionally coupled to second actuation arm 110, rotation of second actuation arm 110 causes a subsequent counterclockwise rotation "F" about first actuation arm pin 108 of first actuation arm 106. Rotation of first actuation arm 106 downwardly displaces displacement rod 142 in the direction "C" and causes an upward displacement of second connection brace 98 in a direction "G". Body panel 80 is thereby forwardly bowed or deflected to infinitely change the amount of lumbar support as desired by the occupant. As first actuation arm 106 rotates in the counterclockwise direction "F", second actuation arm pin 114 is displaced to a position below the center of first actuation arm pin 108 thereby permitting the biasing force of extended second tension spring 128 to further assist with the extension of body panel 80. First tension spring 118 extends during this operation which provides a biasing force to help return lumbar member actuation mechanism 102 to the configuration shown in FIG. 5 when reduced lumbar support is again required.

Figure 10:
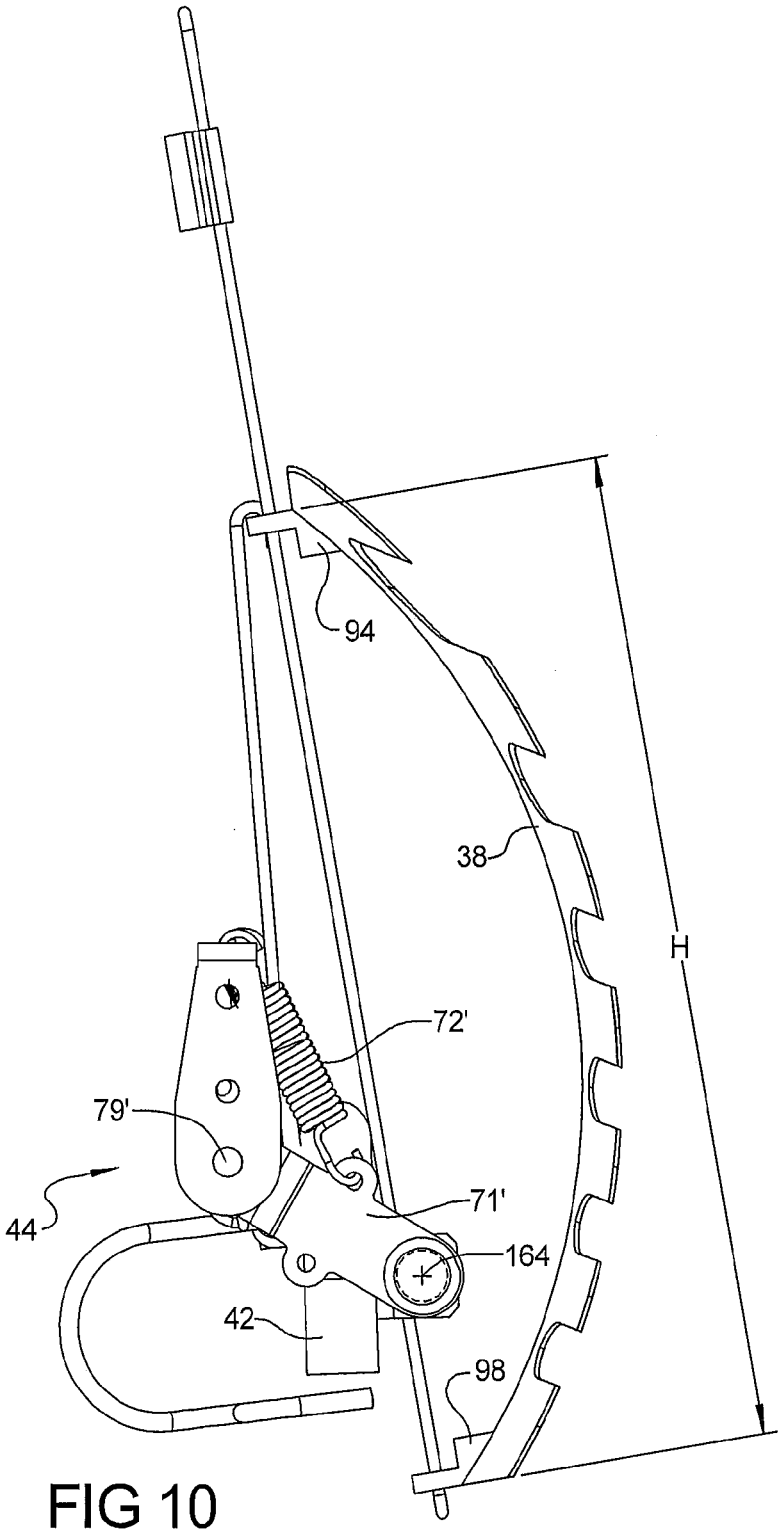
FIG. 10 is a right side elevational view of the lumbar support system in the extended position.

Referring to FIG. 10 and again FIG. 6, the orientation of first support tube biasing mechanism 44 in the back support portion 14 fully upright position is not changed by the full extension of flexible body 38. A spacing "H" decreases between first connection brace 94 and second connection brace 98 as flexible body 38 moves from the fully retracted to the fully extended position.

Figure 7:
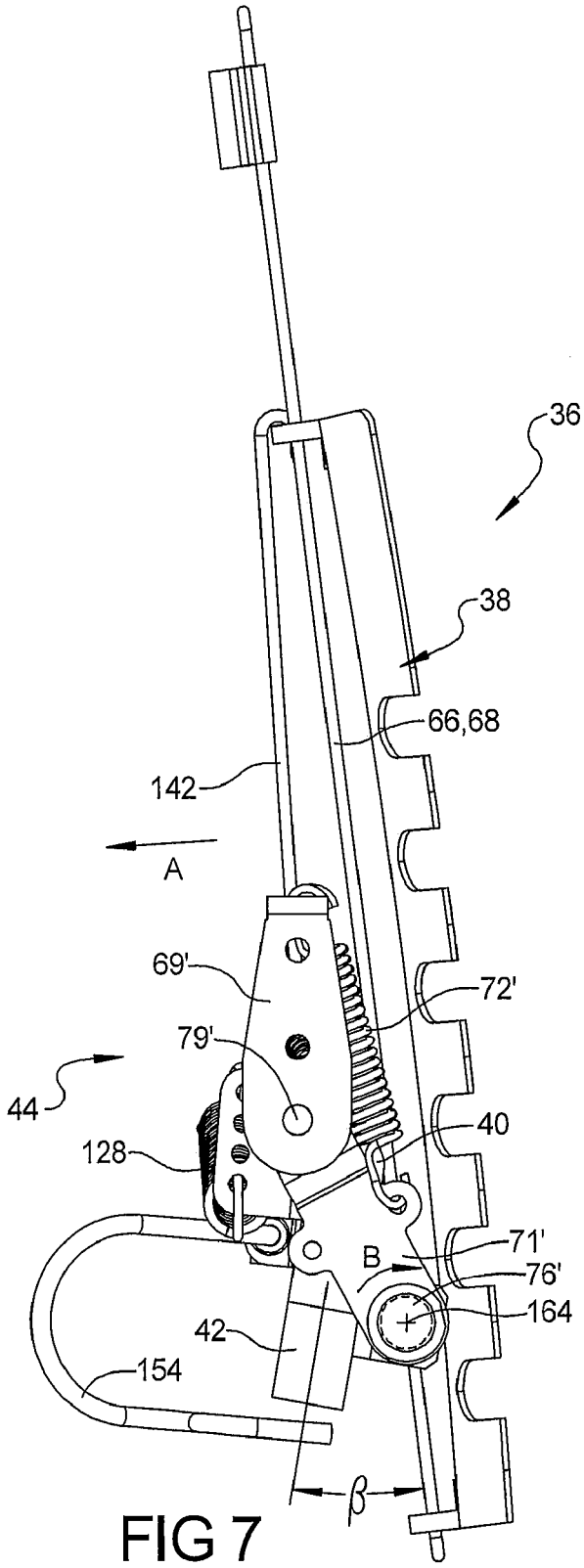
FIG. 7 is the right side elevational view of FIG. 6 showing the lumbar support system initial extension position.
Figure 11:
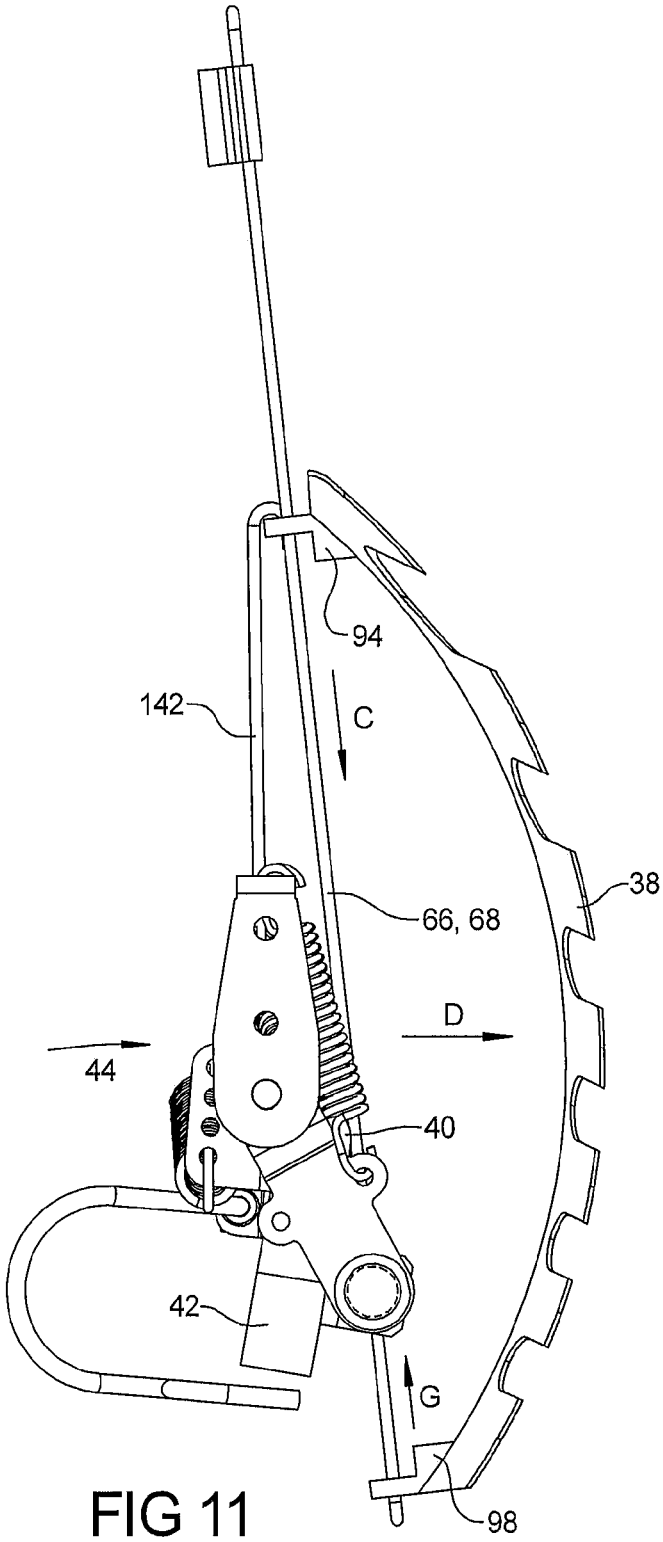
FIG. 11 is a right side elevational view of the lumbar support system in a fully extended position having the lumbar mechanism in an over-center engaged position.

Referring to FIG. 11 and again to FIG. 7, support tube 40 continues to provide contact with first and second guide rods 66, 68 to maintain lumbar support with flexible body 38 in the fully extended position regardless of the orientation of the back support portion 14, including throughout the entire travel to the fully reclined position of back support portion 14. This permits the occupant to change the degree of lumbar support using flexible body 38 and maintain the same relative lumbar support throughout the change in orientation of back support portion 14 from the upright to the fully reclined positions.

Figure 12:
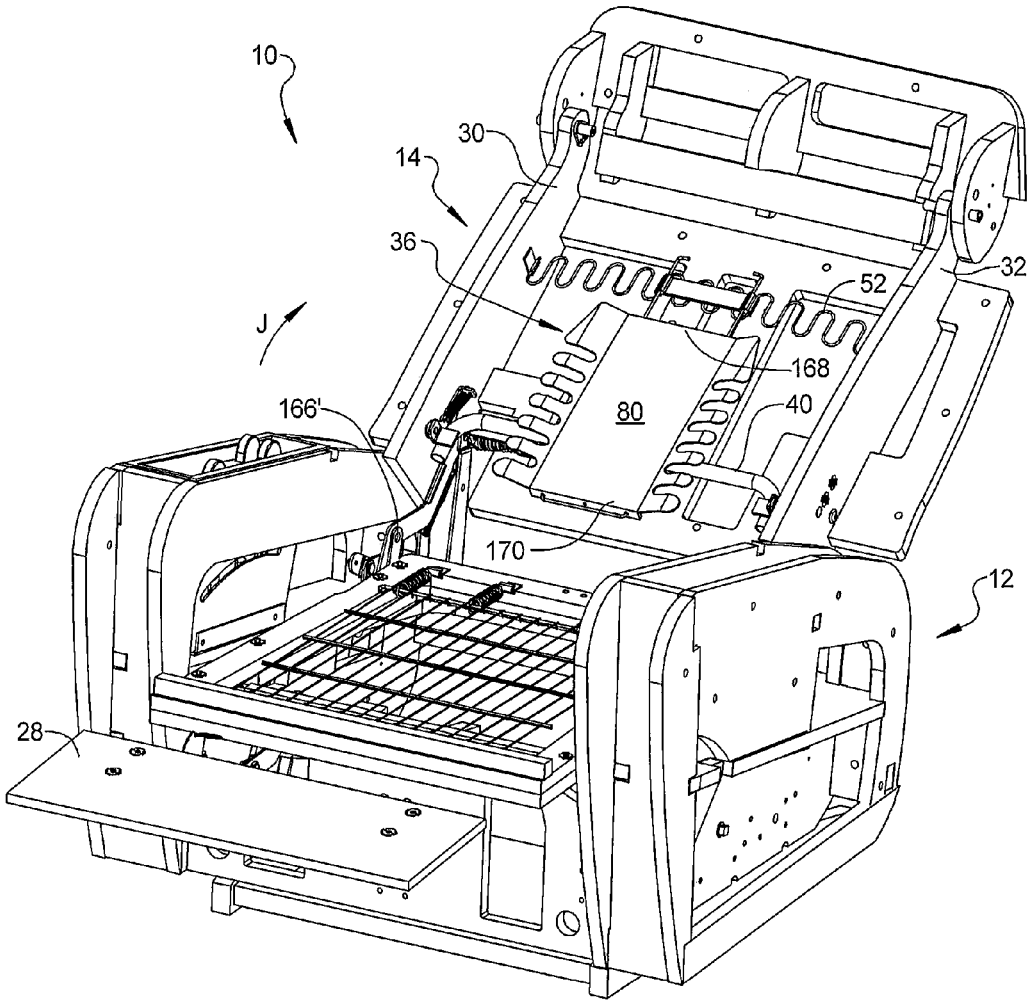
FIG. 12 is a left front perspective view of the furniture member in a reclined position with the lumbar support system in the fully retracted position.

Referring to FIG. 12, the fully reclined position of back support portion 14 is achieved by rotation of back support portion 14 about rotation pins 166, 166' (only rotation pin 166' is visible in this view) which rotatably connect first and second side frame members 30, 32 to base portion 12. Back support portion 14 rotates with respect to base portion 12 about an arc "J". Body panel 80 of lumbar support system 36 is continuously supported at an upper end 168 by flexible member 52 and at a lower end 170 by support tube 40. The retracted position of body panel 80 is not affected by extension or retraction of leg rest 28, which is shown in the fully extended position in FIG. 12.

Figure 13:
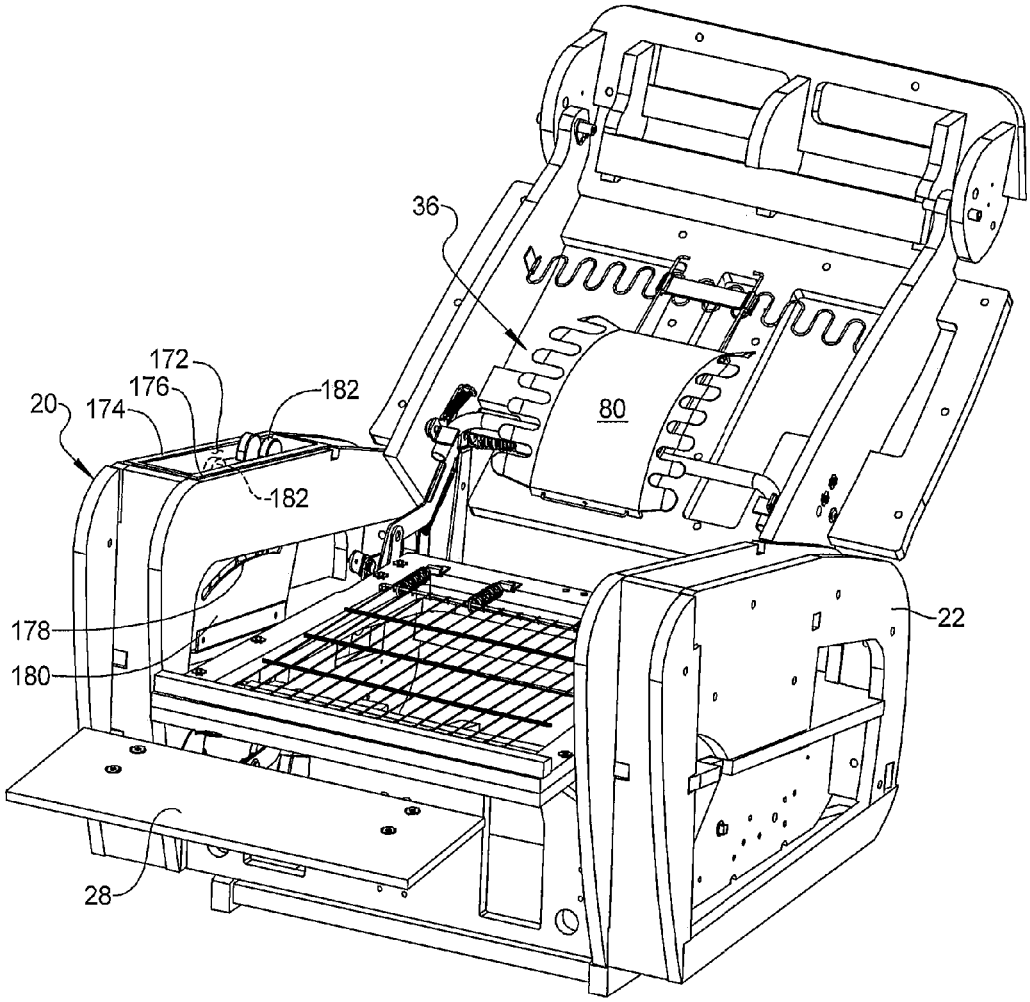
FIG. 13 is a left front perspective view similar to FIG. 12 having the lumbar support system in the fully extended position.

Referring to FIG. 13, the fully extended position of body panel 80 of lumbar support system 36 is shown. The fully extended position of body panel 80 is also not affected by the orientation of leg rest 28. A cavity 172 is created in first arm rest member 20 between an exterior arm rest frame 174 and an interior arm rest frame 176. A lumbar adjustment mechanism 178 is disposed within a mechanism housing 180. Mechanism housing 180 is disposed within cavity 172 and supported between each of the exterior and interior arm rest frames 174, 176. A selection lever 182 is provided with lumbar adjustment mechanism 178. With reference again to FIG. 5, cable 152 is connected to selection lever 182 such that a forward displacement of selection lever 182 to the phantom position shown acts to deflect body panel 80 to the fully extended position shown. According to other embodiments, lumbar adjustment mechanism 178 and mechanism housing 180, or an additional mechanism and housing can also be supported within a similar cavity created in second arm rest member 22.

A lumbar support system of the present disclosure offers several advantages. By providing a flexible body which is able to be deflected either forwardly or rearwardly at the option of the occupant of the furniture member, an unlimited degree of adjustment is available to the occupant for lumbar support between a fully retracted and a fully extended position of flexible body 38. The use of a rotatable support tube 40 of the present disclosure also ensures that lumbar support for the occupant is maintained regardless of extended or fully retracted position for all positions of the back support portion from a fully upright to a fully reclined position. Biasing mechanisms connected to the support tube 40 maintain continuous contact between the support tube and the lumbar support system for all reclining positions. A flexible member such as a sinuous spring used to connect an upper portion of the flexible body 38 to the frame members of the back support portion also permits the upper portion of the flexible body 38 to move forwardly or rearwardly to accommodate increasing load applied to the upper portion of the flexible body 38 as the back support portion 14 rotates to the fully reclined position. Use of a cable and selection lever of the present disclosure provides the occupant with access to adjustment elements for all reclined positions to allow lumbar adjustment in all reclined positions.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An occupant lumbar support system for a furniture member, comprising:

a flexible occupant lumbar support member having first and second connection braces, the lumbar support member deflectable to any one of a plurality of occupant lumbar support positions;

at least one guide rod slidably disposed through both the first and second connection braces operating to slidingly guide the first and second connection braces during movement of one of the first and second connection braces toward or away from the other of the first and second connection braces;

a support tube oriented transverse to the at least one guide rod and rotatable to maintain continuous contact between the support tube and the at least one guide rod such that the support tube provides continuous contact support for a first end of the lumbar support member;

a lumbar member actuation mechanism connected to a body of the support tube;

a bracket fixedly connected to the support tube; and first and second biasing elements each connected to the bracket and to the lumbar member actuation mechanism, the second biasing element having a spring constant and a biasing force greater than a spring constant and a biasing force of the first biasing element, the second biasing element in a fully retracted position of the lumbar support member being flexibly extended, with the second biasing element biasing force acting through an over-center force path permitting the biasing force of the first biasing element to retain the fully retracted position of lumbar support member.

2. The lumbar support system of claim 1, further including a rigid displacement rod connected at a first end to one of the first and second connection braces.

3. The lumbar support system of claim 2, further including a displacement rod engaged to both the lumbar member actuation member and the first connection brace, rotation of the support tube operating to release the over-center force path of the second biasing element such that the biasing force of the second biasing element acting through the displacement rod assists to translate the one of the first and second connection braces to move toward the other, deflecting the flexible occupant lumbar support member to any one of the plurality of lumbar support positions.

4. The lumbar support system of claim 3, further comprising a furniture member having a back seat portion including first and second wings connected to an occupant support base member, the lumbar member actuation mechanism positioned between the first and second wings.

5. The lumbar support system of claim 4, further comprising a biasing member connected to the first and second wings and to a second end of the lumbar support member to allow forward and rearward movement of the second end.

6. The lumbar support system of claim 1, wherein the support tube includes first and second tube ends oriented transverse to a body of the support tube.

7. The lumbar support system of claim 6, further comprising:

a furniture member having a back seat portion including first and second wings; and first and second biasing mechanisms individually connecting the first and second tube ends to one of the first and second wings, the first and second biasing mechanisms operating to bias the support tube into contact with the occupant lumbar support member from a fully upright to a fully reclined position of the back seat portion inclusive.

8. The lumbar support system of claim 1, further comprising:

a rigid displacement rod connected at a first end to one of the first and second connection braces;

the lumbar member actuation mechanism including:

a rotatable first actuation arm having a second end of the displacement rod connected thereto;

a second actuation arm frictionally connected to the first actuation arm such that rotation of the second actuation arm causes co-rotation of the first actuation arm; and a third actuation arm independently rotatably connected to the first actuation arm.

9. The lumbar support system of claim 8, wherein the lumbar member actuation mechanism further includes:

the first biasing element connected to the second actuation arm operating to normally bias the second actuation arm against displacement of the displacement rod; and the second biasing element connected to the third actuation arm.

10. The lumbar support system of claim 8, wherein the third actuation arm is rotatably connected to the first actuation arm using a rotational fastener located in a over-center position creating the over-center force path when the lumbar support member is in the fully retracted position with respect to a connector connecting the second actuation arm to the first actuation arm.

11. The lumbar support system of claim 8, further comprising a cable connected to the second actuation arm operable when retracted to co-rotate the first and second actuation arms to translate the displacement rod and deflect the lumbar support member.

12. An occupant lumbar support system for a furniture member, comprising:

a flexible occupant lumbar support member having first and second connection braces, the lumbar support member deflectable to any one of a fully retracted position and a plurality of occupant lumbar support extended positions;

a rigid displacement rod connected at a first rod end to one of the first and second connection braces;

a lumbar member actuation mechanism positioned rearward of the lumbar support member having a rotatable first actuation arm engageably receiving a second rod end of the displacement rod, the lumbar member actuation member operating to translate the displacement rod causing one of the first and second connection braces to move toward the other of the first and second connection braces, deflecting the flexible occupant lumbar support member to any one of the lumbar support positions; and a cable connected at a first end to a second actuation arm of the lumbar member actuation mechanism and at a second end to a displaceable lever manually movable to co-rotate both the first and second actuation arms and to translate the displacement rod;

a support tube in rotatable contact with the lumbar support member having the lumbar member actuation mechanism connected to the support tube;

a bracket connected to the support tube; and first and second biasing elements individually connected to each of the bracket and the lumbar member actuation mechanism, the first biasing element biasing the lumbar support member toward the fully retracted position when a biasing force of the second biasing element acts through an over-center position with respect to the lumbar member actuation mechanism, the second biasing element when moved away from the over-center position acting to assist deflection of the lumbar support member toward the lumbar support extended positions.

13. The lumbar support system of claim 12, further including at least one guide rod slidably disposed through both the first and second connection braces operating to slidingly guide the first and second connection braces during movement toward and away from each other.

14. The lumbar support system of claim 13, wherein the support tube is oriented transverse to the at least one guide rod and is rotatable to maintain continuous contact of a body of the support tube with the at least one guide rod such that the support tube provides continuous contact support for a first end of the lumbar support member.

15. The lumbar support system of claim 12, wherein the lumbar member actuation mechanism further includes:

a third actuation arm independently rotatably connected to the first actuation arm;

the first biasing element connected to the second actuation arm operating to normally bias the second actuation arm against displacement of the displacement rod; and the second biasing element connected to the third actuation arm operating to normally bias the third actuation arm to displace the displacement rod.

16. A furniture member lumbar support system, comprising:

a back support portion connected to a base portion, the back support portion including opposed first and second wings; and a lumbar support system connected to the back support portion, the lumbar support system including:

a support tube rotatably connected to the first and second opposed wings;

a flexible occupant lumbar support member in continuous contact with the at least one support tube;

a lumbar adjustment mechanism supported by the base portion operating to deflect the lumbar support member to a plurality of lumbar support positions;

a lumbar member actuation mechanism connected to a body of the support tube;

a bracket fixedly connected to the support tube; and first and second biasing elements each connected to the bracket and to the lumbar member actuation mechanism, the second biasing element having a spring constant and a biasing force greater than a spring constant and a biasing force of the first biasing element, the second biasing element in a fully retracted position of the lumbar support member being flexibly extended, with the second biasing element biasing force acting through an over-center force path permitting the biasing force of the first biasing element to retain the fully retracted position of lumbar support member.

17. The lumbar support system of claim 16, wherein the plurality of support positions includes at least the fully retracted position and a maximum extended position having the lumbar support member arched forwardly with respect to the back support portion.

18. The lumbar support system of claim 17, wherein the lumbar adjustment mechanism includes a manually displaceable lever moveable forward and rearward, with forward motion operating to reposition the lumbar support member between the fully retracted and the maximum extended positions and infinitely therebetween.

19. The lumbar support system of claim 16, further comprising:

a rigid displacement rod connected at a first end to one of the first and second connection braces; and the lumbar member actuation mechanism including a rotatable first actuation arm having a second end of the displacement rod connected thereto.

20. The lumbar support system of claim 19, wherein the lumbar member actuation mechanism further includes:

a second actuation arm frictionally connected to the first actuation arm such that rotation of the second actuation arm causes co-rotation of the first actuation arm; and a third actuation arm independently rotatably connected to the first actuation arm.

21. The lumbar support system of claim 16, further comprising:

an armrest member of the base portion;

interior and exterior armrest frames of the armrest member; and a housing adapted to contain the lumbar adjustment mechanism within a cavity defined between the interior and exterior armrest frames.

22. The lumbar support system of claim 16, wherein the lumbar support member comprises a polymeric body having homogenous first and second connection braces defining opposed ends of the lumbar support member.

23. The lumbar support system of claim 16, wherein the back support portion is rotatable with respect to the base portion within a range bounded by an upright position and a fully reclined position with the support tube continuously rotating as the back support portion rotates to maintain continuous contact with the lumbar support member.

24. The lumbar support system of claim 16, further comprising a leg rest member extensibly connected to the base portion and extendable within a range bounded by a fully retracted position and a fully extended position, without altering any one of the plurality of support positions of the lumbar support member.

25. The lumbar support system of claim 16, further comprising a biasing member connected to the first and second wings and to an upper end of the lumbar support member to allow forward and rearward movement of the upper end.

26. A method for controlling an occupant lumbar support system of a furniture member, including a flexible occupant lumbar support member having first and second connection braces, first and second guide rods, and a support tube, the method comprising:

slidably disposing both the first and second guide rods through both the first and second connection braces to guide one the first and second connection braces for movement toward and away from the other;

biasing a rotatable support tube transversely oriented to the first and second guide rods to maintain continuous contact of a body of the support tube with the first and second guide rods such that the support tube provides continuous contact support for a first end of the lumbar support member;

applying a biasing force of a first biasing element to bias the lumbar support member toward a fully retracted position while a biasing force of a second biasing element is directed toward an over-center position with respect to the first biasing element;

moving the second biasing element away from the over-center position; and deflecting the lumbar support member using a biasing force of the second biasing element to any one of a plurality of extended occupant lumbar support positions.

27. The method of claim 26, further comprising connecting a biasing member transversely to the first and second guide rods at a second end of the lumbar support system to allow forward and rearward movement of the second end.

* * * * *